US005957080A

United States Patent [19]

Ovard

[11] Patent Number: 5,957,080

[45] Date of Patent: Sep. 28, 1999

[54] FOLDING PORTABLE BOAT

[76] Inventor: Gary D. Ovard, 331 Pine Grove Dr., Quitman, Tex. 75783

[21] Appl. No.: 09/085,376

[22] Filed: May 26, 1998

[51] Int. Cl.[6] ..... B63B 7/00

[52] U.S. Cl. ..... 114/353

[58] Field of Search ..... 114/343, 352–354, 114/363, 77 A, 77 R

[56] References Cited

U.S. PATENT DOCUMENTS

| | | | |
|---|---|---|---|
| 2,714,387 | 8/1955 | Meldrum . | |
| 3,083,382 | 4/1963 | Havens et al. . | |
| 3,422,829 | 1/1969 | Adams | 135/6 |
| 3,724,011 | 4/1973 | Scholle | 9/2 F |
| 3,932,906 | 1/1976 | Johnson | 9/2 C |
| 4,075,724 | 2/1978 | Hire | 9/2 F |
| 4,180,881 | 1/1980 | Speranza | 9/2 F |
| 4,223,623 | 9/1980 | Brunet et al. | 114/77 |
| 4,522,143 | 6/1985 | Holzbaur | 114/344 |
| 4,561,376 | 12/1985 | Fitzgerald-Smith | 114/267 |
| 4,683,900 | 8/1987 | Carmichael | 135/88 |
| 4,706,597 | 11/1987 | Figone | 114/353 |
| 4,754,723 | 7/1988 | Ghering | 114/353 |
| 5,070,807 | 12/1991 | Lewis | 114/361 |
| 5,158,035 | 10/1992 | Tanabe | 114/354 |
| 5,203,276 | 4/1993 | Methven | 114/354 |
| 5,257,594 | 11/1993 | Methven | 114/354 |
| 5,353,733 | 10/1994 | Evans | 114/353 |

FOREIGN PATENT DOCUMENTS

| | | | |
|---|---|---|---|
| 1456312 | 11/1968 | Germany | 114/353 |

*Primary Examiner*—Ed Swinehart
*Attorney, Agent, or Firm*—Carla J. Dolce

[57] ABSTRACT

A folding portable boat is disclosed comprising two end hull sections and two middle hull sections each hull section being of a floatation material. The hull sections are hingedly interconnected adjacent to each other so they can be folded and unfolded in an accordion manner. The portable boat further comprises two seat boards, each collapsibly associated with one of the middle hull sections, and an arrangement of elastic cords for causing the seat boards to erect as the hull sections are unfolded and to collapse as the hull sections are folded.

18 Claims, 5 Drawing Sheets

FOLDING PORTABLE BOAT

FIELD OF THE INVENTION

The invention relates to portable boats and more particularly to a portable folding boat with seat boards that erect automatically as the boat is unfolded for use and collapse as the boat is folded for transportation or storage.

BACKGROUND OF THE INVENTION

Many people who would enjoy recreational boating do not have storage or transportation facilities for standard sized boats. Additionally, many larger recreational boats do not have storage space for dinghies. Existing portable folding boats are expensive to manufacture, difficult to assemble, do not have seats and/or are not small enough to be transported in the average sized automobile. There are no folding portable boats that have seat board that erect automatically on unfolding the boat.

For example, the portable boat disclosed in U.S. Pat. No. 5,257,594, is difficult to fold for storage and to unfold and prepare for use because it requires manual assembly and disassembly of the seats and transom. The portable boat disclosed in U.S. Pat. No. 4,706,597 is complex and expensive to manufacture. The portable boat disclosed in U.S. Pat. No. 5,158,035 requires removal of supporting plates to fold the boat and installation of the supporting plates to hold the boat open for use. Additionally, that boat is not small enough in its folded position to fit in an automobile. Finally, none of the above-mentioned portable boats is made of a floatation material. Thus, existing portable boats are subject to holing and swamping.

There is a need for a portable boat that is inexpensive to manufacture, that can be transported in an average sized automobile, that is made of a floatation material, that can be stored in minimal space, and that assembles easily.

Therefore, it is an object of the present invention to provide a folding portable boat that is simple to fold for storage and to unfold for use, that is inexpensive to manufacture and that can fit in the average size automobile.

It is a another object of the invention to provide a folding portable boat with seat boards that erect automatically when the boat is unfolded and collapse automatically when the boat is folded for storage.

It is another object of the invention to provide a folding portable boat made of a floatation material so that it is not subject to holing or swamping and is self-bailing.

It is yet another object of the present invention to provide a folding portable boat with a folding transom to which an optional motor or rudder can be attached. It is also an object of the present invention to provide a transom that is able to resist breaking by deflecting forward or backward when force is transmitted to the transom in either direction through force exerted on a motor or a rudder and that returns to an approximately vertical position when the force is removed.

It is yet another object of the invention to provide a folding portable boat that has an attachable and detachable centerboard, rudder and mast so the boat can serve as a sail boat.

The foregoing specific objects of the present invention are illustrative of those that can be achieved by the invention and are not intended to be exhaustive or limiting of the possible advantages which can be realized. These and other objects and advantages of the invention will be apparent from the description herein or can be learned from practicing the invention as described herein or as modified in view of any variations which may be apparent to those skilled in the art.

SUMMARY OF THE INVENTION

The present invention, in its simplest form, comprises two end hull sections and two middle hull sections each hull section being of a floatation material and each hull section having an outer portion, an inner portion and opposed lateral side portions. The hull sections are hingedly interconnected adjacent to each other so they can be folded and unfolded in an accordion manner with the inner portion of each end hull section hingedly connected to the outer portion of one middle hull section and the middle hull sections hingedly connected to each other at their inner portions. Two seat boards are provided, each collapsibly associated with one of the middle hull sections. Finally, an erecting/collapsing means is provided for each seat board for causing the seat board to erect as the hull sections are unfolded and to collapse as the hull sections are folded.

The portable folding boat of the present invention may further comprise a collapsible transom for mounting a motor or a rudder. The transom may be constructed so that force transmitted to the transom in either direction through force exerted on a motor or a rudder causes the transom to deflect forward or backward and return to an approximately vertical position when the force is removed.

The folding portable boat may have one or more removable centerboards, a removable mast and sail, a removable rudder, and/or one or more storage compartments. The boat may also have a gunwale which serves both to form a compartment into which the seat boards fold and to provide a place for openings for lines and/or handholds. The boat may further have a removable canopy.

The foregoing main features and other features of the invention are more particularly described below.

DETAILED DESCRIPTION

Figure 2:
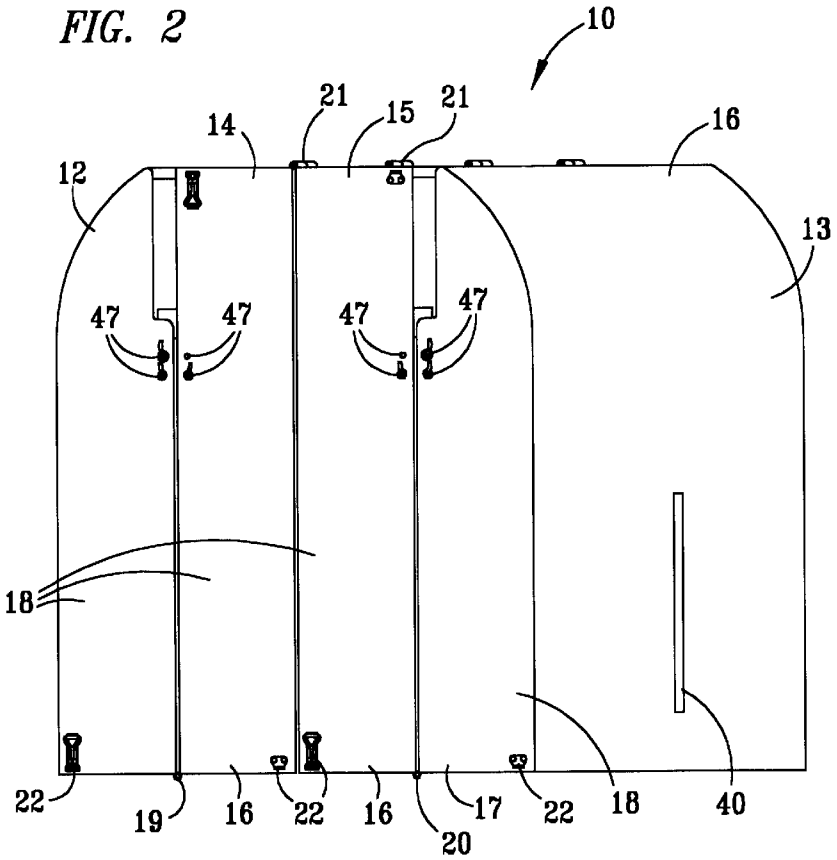
FIG. 2 is a perspective side view of the invention in a folded position from the other end hull section.
Figure 1:
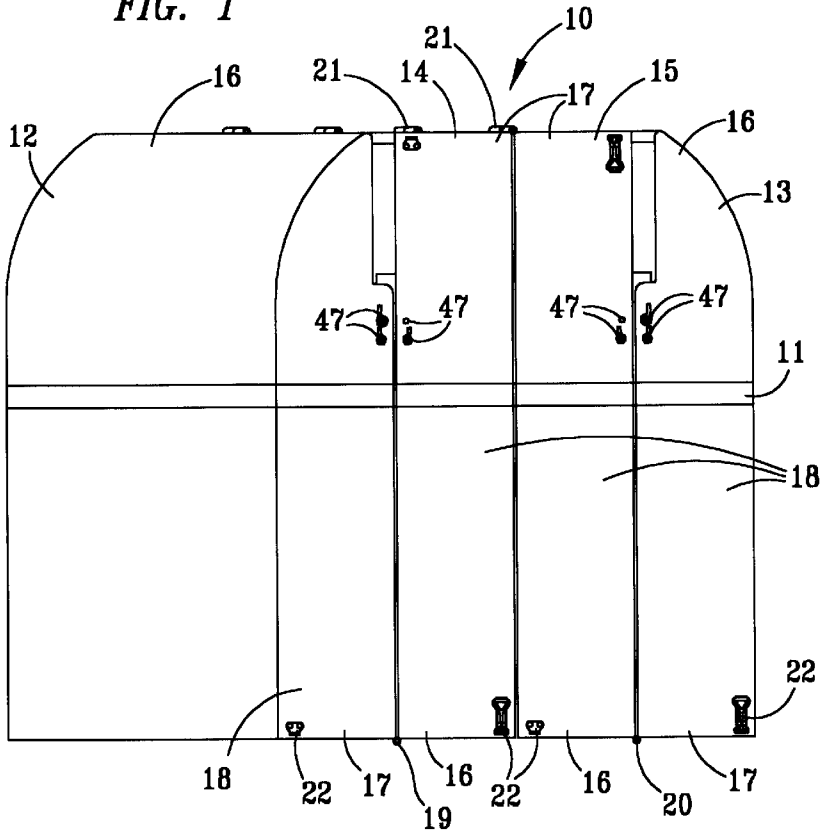
FIG. 1 is a perspective side view of the invention in a folded position from one end hull section.

In FIGS. 1 and 2, the folding portable boat 10 of the invention is shown in its fully folded position. The folding portable boat 10 may have a holding means for holding the hull sections in a folded position when the boat is folded. The holding means may be a strap 11 secured around the boat as shown in FIG. 1 to hold it securely in the folded position for transport or storage.

In its most basic embodiment, the folding portable boat comprises two end hull sections 12 and 13 and two middle hull sections 14 and 15, each hull section being of a floatation material and each hull section having an outer portion 16, an inner portion 17 and opposed lateral side portions 18. The hull sections 12, 13, 14, and 15 are hingedly interconnected adjacent to each other so they can be folded and unfolded in an accordion manner with the inner portion 17 of each end hull section 12 and 13 hingedly connected to the outer portion 16 of one middle hull section 14 or 15 and the middle hull sections 14 and 15 hingedly connected to each other at their inner portions 17.

The end hull sections 12 and 13 are hingedly connected to one of the middle hull sections 14 and 15 by means of end hull hinges 19 and 20 which are preferably piano-type hinges. A middle hull hinge 21 connects the middle hull sections 14 and 15 to each other. Preferably middle hull hinge 21 comprises at least two detachable-type hinges that can be separated so that the folding portable boat can be separated into two independent parts. This makes the boat 10 easier to store and easier to transport. Each independent part can fit in the back seat of the average size automobile.

Figure 13:
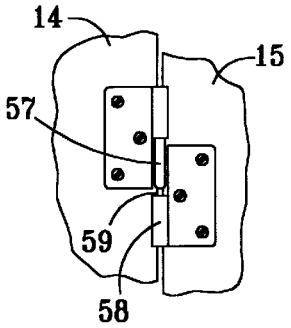
FIG. 13, is a top plan view of a detachable hinge.
Figure 14:
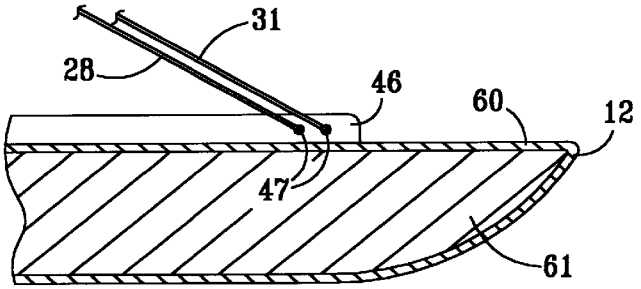
FIG. 14 is a cut away side view of end hull section 12 taken along the lines 14—14 in FIG. 6.

Detachable-type hinges are well known. One such hinge, shown in FIG. 13, comprises two parts, namely a pin 57 attached to one middle hull section 14 and a hollow tubular-shaped part 58 attached to the other middle hull section 15, the tubular part 58 having an opening 59 for engaging the pin. When the middle hull sections 14 and 15 are moved in opposite parallel directions on the same horizontal plane, the pin 57 slides out of the opening 59 releasing the two hull sections. When the middle hull sections 14 and 15 are moved on the same horizontal plane in parallel directions to align their inner hull portions 17, the pin 57 engages the opening 59 of the hollow tubular part 58 hinging the middle hull sections 14 and 15 together.

Preferably, when the folding portable boat is in its fully unfolded position, the hull sections 12, 13, 14, and 15 are secured in the unfolded position by two-part latch clamps 22 shown in FIGS. 1–4. The hull sections 12, 13, 14, and 15 may also be secured by a hasp and lock or any equivalent means, not shown in the drawings.

The portable folding boat of the present invention in its most basic embodiment further comprises two seat boards 23, each collapsibly associated with one of the middle hull sections 14 and 15, and an erecting/collapsing means for each seat board 23 for causing the seat board 23 to erect as the hull sections are unfolded and to collapse as the hull sections are folded.

The erecting/collapsing means for each seat board 23 may be any combination of mechanical parts that causes the seat board 23 to erect as the hull sections 12, 13, 14, and 15 are unfolded and to collapse as the hull sections 12, 13, 14, and 15 are folded. One such erecting/collapsing means shown in FIGS. 3, 4, 5 and 6 comprises an arrangement of elastic cords 28 that, when the hull sections 12, 13, 14 and 15 are unfolded in an accordion manner, operates to erect seat board 23 to its functional horizontal position by raising the back 24 and side boards 23 to upright vertical position. Seat board 23 is hingedly connected to the back 24 so that when the back 24 is pulled to its upright vertical position by elastic cords 28, seat board 23 falls by gravity to its erect horizontal position. In its totality, the erecting/collapsing means shows in FIGS. 3, 4, 5 and 6 comprises a back 24 having an upper edge, a lower edge and two side edges the lower edge hingedly connected to the outer portion 16 of one of the middle hull sections 14 and 15. Flanges 25 extend perpendicularly from each of the two side edges of the back 24 with each flange 25 having an opening 27 in that part of the flange 25 extending from the upper edge of the back 24.

The seat board 23 is hingedly connected to the upper edge of the back. Two side boards 26 are each hingedly connected to one of the two lateral side portions 18 of one of the middle hull sections 14 and 15. Two elastic means, such as elastic cords 28, are each affixed to one lateral side portion 18 of one of the end hull sections 12 and 13 and each elastic means extending through one of the openings 27 in one of the flanges 25 and from there affixed to one of the two side boards 26. The elastic means may also be springs made of a noncorrosive metal such as stainless steel. As the hull sections 12, 13, 14, and 15 are unfolded in an accordion manner the two elastic means operate to pull the back 24 to an upright vertical position while simultaneously pulling the two side boards 26 to upright vertical positions with the seat board 23 falling by gravity to a horizontal position perpendicular to the side boards 26 and the back 24. One skilled in the art will appreciate, from the geometric arrangement shown in FIGS. 3, 4, 5 and 6, that the reversal the foregoing steps for erecting the folding boat will cause it to collapse.

Preferably, the erecting/collapsing means also includes a side board securing means for securing the side boards 26 in upright vertical positions during use when the hull sections are fully unfolded. If the seat boards are made of a relatively thin or weak material as shown in FIGS. 3, 4, 5, and 6, the seat board 23 preferably has seat board brace 29 extending around the outer perimeter of the seat board 23 except that side where the seat board 23 is hinged to the back 24. In this case, as shown in FIGS. 3, 4, 5 and 6, the side board securing means may comprise two slots 30 in the seat board brace 29, one for engaging each of the side boards 26 to hold the side boards 26 in upright vertical positions. If the seat board 23 is of a thicker, rigid material (not shown in the drawings), no seat board brace 29 is needed and the two slots 30 are in the underside of the seat board 23, each slot for engaging one of the side boards 26 to hold the side boards 26 in upright vertical positions.

Preferably, the erecting/collapsing means also includes a back securing means for securing the back 24 in an upright vertical position during use when the boat is fully unfolded. As shown in FIGS. 3, 4, 5 and 6, the back securing means may comprise at least one first cord 31 attached at one end to one lateral side portion 18 of one of the end hull sections 12 and 13 and attached at an opposing end to the upper edge of the back 24 or the flange 25. The first cord 31 is fully extended when the hull sections are unfolded and the back 24 is substantially vertical so that it is substantially perpendicular to the horizontal plane of the hull sections. The first cord 31 is preferably made of a flexible but substantially non-stretchable material so that when the hull sections are fully unfolded, the first cord 31 prevents the back from moving in an arc away from the end hull section 12 or 13.

To prevent the back 24 from moving in an arc toward the end hull section 12 or 13, an opposing cord 32 is attached at one of its ends to one lateral side portion 18 of one of the middle hull sections 14 and 15 and attached at an opposing end to that part of the flange 25 extending from the back 24 at the point approximately opposite to the point on the back 24 where the first cord 31 is attached. The opposing cord 32 is fully extended when the hull sections are unfolded and the back 24 is substantially vertical. Like the first cord 31, the opposing cord 32 is preferably made of a flexible but substantially non-stretchable material so that when the hull sections are fully unfolded, the opposing cord 32 prevents the back from moving in an arc toward the end hull section 12 or 13.

An alternative back securing means, not shown in the drawings, comprises at least one releasable pin extending through both the seat board 23 and the side board 26 where one of the slots 30 in the seat board 23 engages one of the side boards 26. If the seat boards 23 have seat board brace 29, the releasable pin would extend through the seat board brace 29 and through the side board 26 where it could be secured by a cotter pin on the inside of the seat board brace 29.

Preferably, the folding portable boat 10 further comprises a collapsible transom 33 for mounting a motor or a rudder (not shown). As shown in FIGS. 4, 6–10, the transom 33 may comprise a transom plate 34 hingedly attached to the outer portion 16 of end hull section 12. Because the boat 10 is symmetrical, the transom could be attached to end hull section 13 rather than end hull section 12. The transom plate has an approximately smooth inward facing surface 35. A support plate 36 is hingedly attached to the end hull section 12 inwardly from the transom plate 34 toward the middle hull sections 14 and 15 for supporting the transom plate 34 in an approximately vertical position by engaging the approximately smooth inward facing surface 35 of the transom plate 34.

Figure 4:
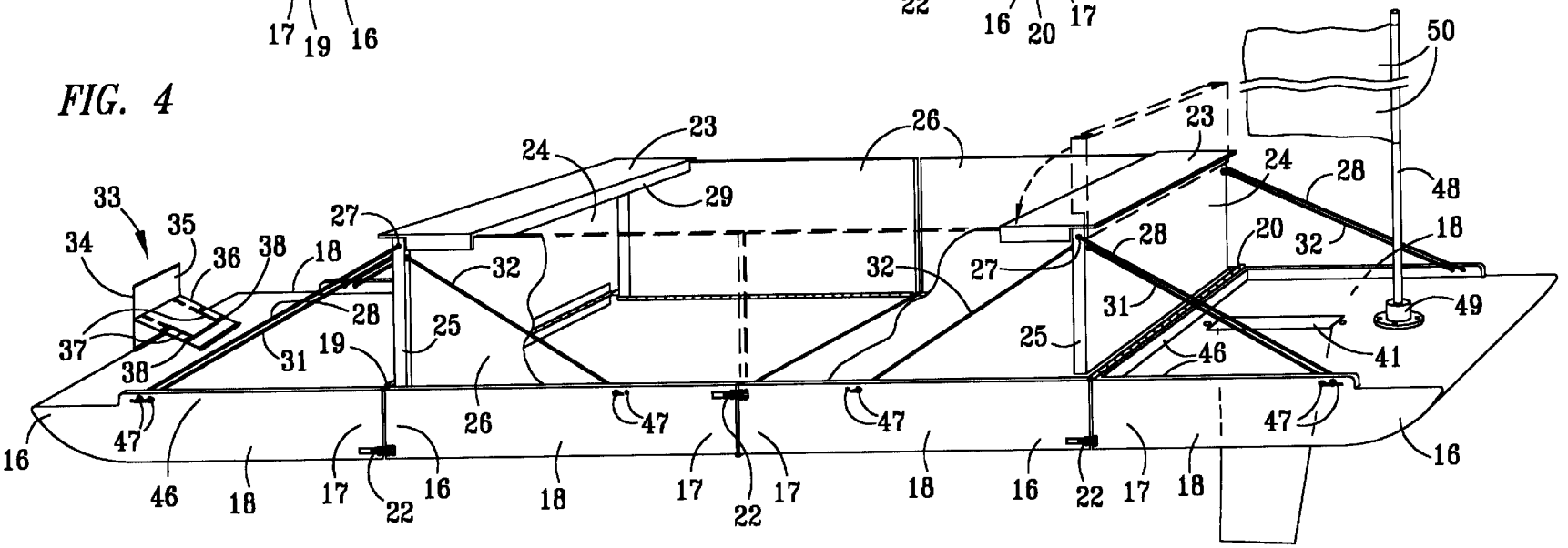
FIG. 4 is a perspective side view of the invention in an unfolded position with the side boards partially cut away.
Figure 5:
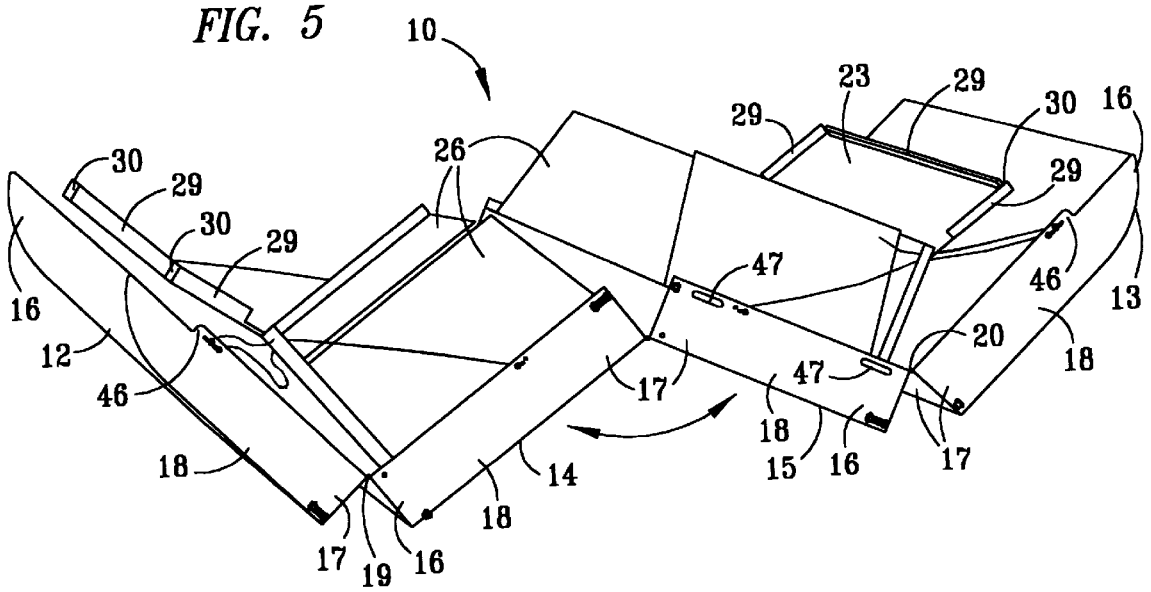
FIG. 5 is a second perspective side view of the invention in a partially unfolded position.
Figure 6:
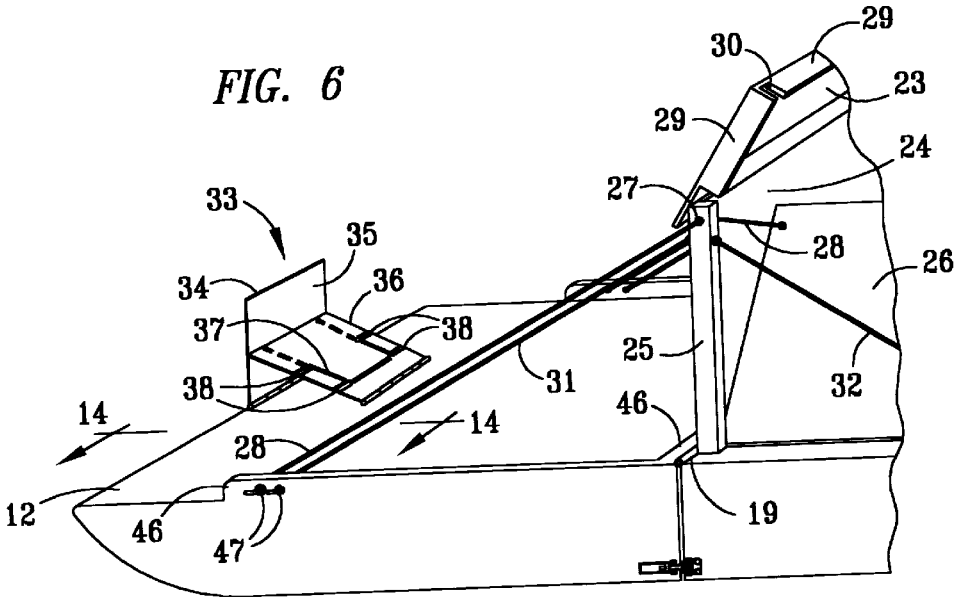
FIG. 6 is a cut away perspective view of the invention showing the optional transom and showing details of one means for causing the seat boards to erect as the hulls are unfolded.
Figure 7:
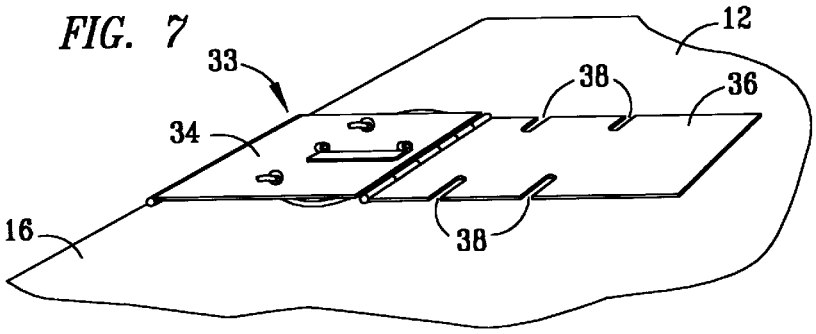
FIG. 7 is a cut away perspective side view showing the transom in a folded position.
Figure 8:
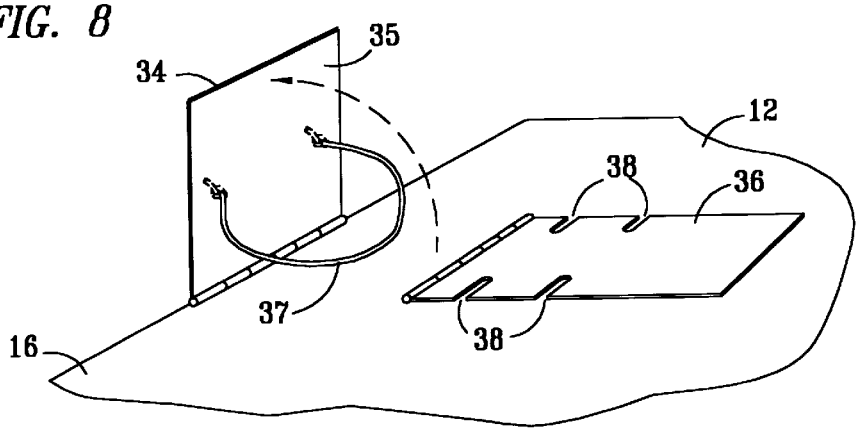
FIG. 8 is a cut away perspective side view showing the transom with the transom plate raised to an approximately vertical position.
Figure 9:
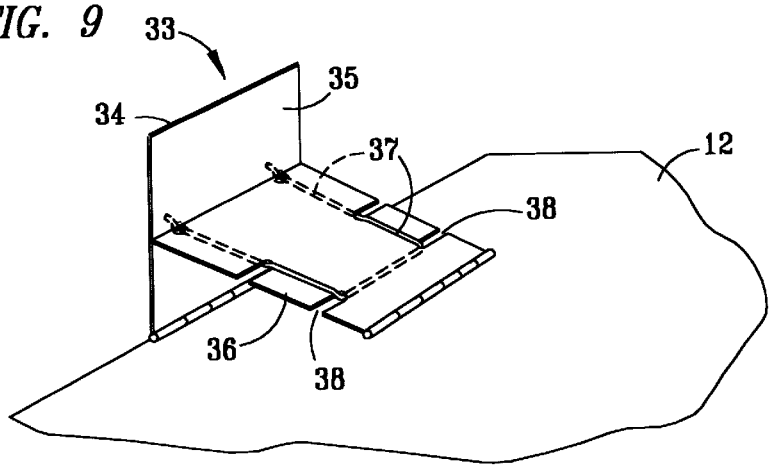
FIG. 9 is a cut away perspective side view of the transom in its fully assembled position.

To hold the support plate 36 against the inward facing surface 35 of the transom plate 34 for supporting the transom plate 34 in an approximately vertical position, an elastic means 37 is attached to the transom plate 34 and extends to the support plate 36 for releasably engaging the support plate 36. When the elastic means 37 is released from the support plate 36 both the support plate 36 and the transom plate 34 fold, as shown in FIG. 7, to permit the hull sections 12, 13, 14, and 15 to be folded for storage. When the elastic means 37 is engaged it holds the support plate 36 in a fixed position against the inward facing surface 35 of the transom plate 34, as shown in FIGS. 4, 6 and 9.

When force is transmitted to the transom plate 34 in either direction through force exerted on a motor or a rudder, the transom plate 34 deflects forward or backward and returns to an approximately vertical position when the force is removed. When the force causes the transom plate to move away from the end hull section 12, the elastic means 37 permits the transom plate 34 to move and pulls the transom plate 34 back into an approximately vertical position when the force is removed. If the force causes the transom plate 34 to move toward the end hull section 12, the support plate 36 slides up along the approximately smooth inward-facing surface 35 of the transom plate 34 permitting the transom plate 34 to move toward the end hull section 12. When the force is removed, the elastic means pulls the transom plate 34 back to an approximately vertical position.

The inward facing surface 35, needs to be smooth enough to permit the support plate 36 to slide upward to deflect any force causing the transom plate 34 to move toward the end hull section 12. As shown in FIGS. 4, 6, 8 and 9, the elastic means 37 may be an elastic cord attached at each end to the transom plate 34 and forming a loop of elastic cord, tied through holes in the transom plate 34, that extends to and engages the support plate 36 by stretching over and looping over notches 38 in each side of the support plate 36.

Figure 10:
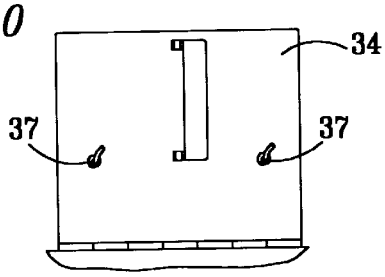
FIG. 10 is a cut away rear view of the transom in its fully assembled position.

As shown in FIG. 10, the outward facing surface of the transom plate 34 has one part of a detachable hinge for mating with the other part of a detachable-type hinge on a rudder (not shown). A rudder or a motor may be attached to the transom plate 34 by any other means known in the art.

Figure 3:
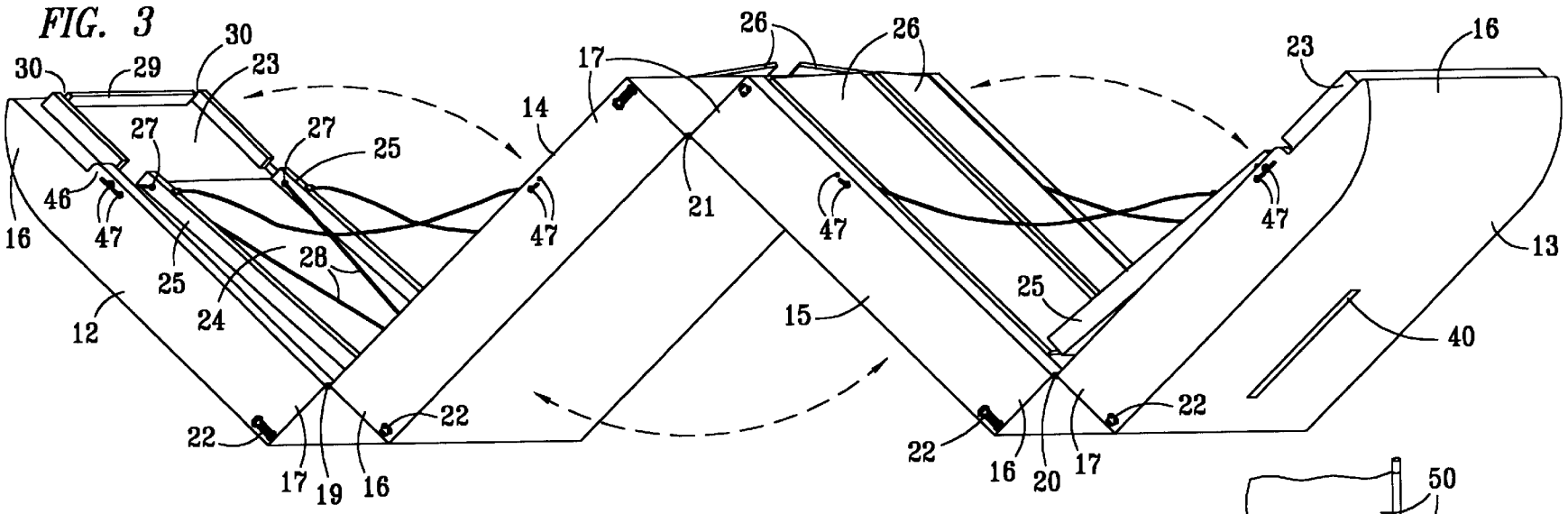
FIG. 3 is a perspective side view of the invention in a partially unfolded position.

To improve the control and stability of folding portable boat 10, a removable centerboard 39, may be attached to one of the end hull sections 12 or 13. The centerboard 39 may be attached after the hull sections are unfolded and removed prior to folding the hull sections. As shown in FIGS. 3 and 4, the centerboard 39 may slide through a centerboard slot 40 and engage the upper surface of the end hull section 13 with centerboard flange 41. Although not shown in the drawings, a second centerboard may likewise be removably attached to end hull section 12.

Figure 11:
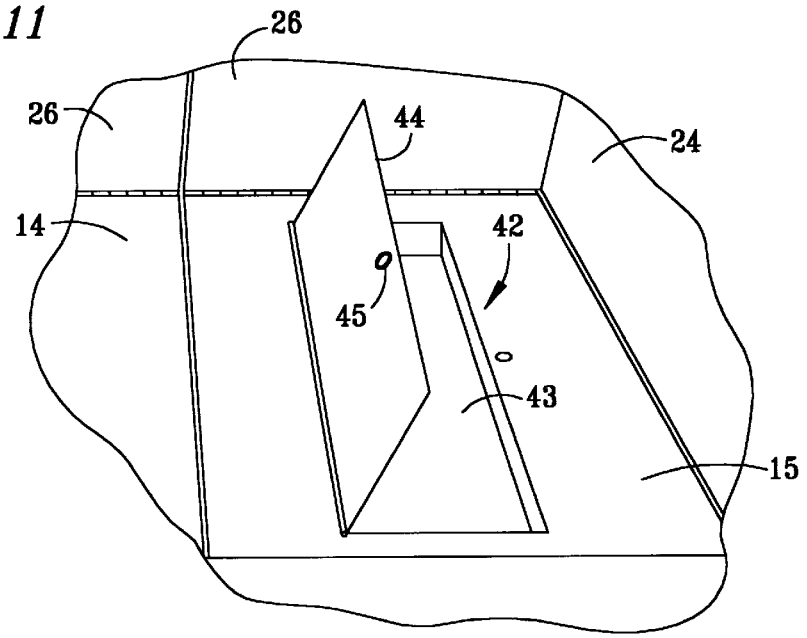
FIG. 11 is a cut away perspective view showing a storage compartment in one of the middle hull sections of the folding portable boat of the invention.

Preferably, the folding portable boat 10 has a storage compartment 42 in one or both of the middle hull sections 14 and 15. As shown in FIG. 11, the storage compartment 42 may comprise an approximately rectangular cavity 43 in the middle hull section 15. The storage compartment 42 has a cover 44 hingedly connected to one edge of the rectangular cavity 43 for covering the entire cavity 43. The cover may have a clasp 45 for holding the cover closed.

Preferably, the folding portable boat 10 has a gunwale 46 extending along the length of the lateral side portions 18 and the outer portions 16 of the two middle hull sections 14 and 15, along the inner portions 17 of the two end hull sections 12 and 13 and along approximately two-thirds of the length of the lateral side portions 18 of both end hull sections 12 and 13.

The gunwale serves several purposes. First, it defines a compartment into which the seat boards 23 and the erecting/collapsing means collapse when the hull sections 12, 13, 14, and 15 are folded. It also provides a place for the hinge attaching the back 24 to the middle hull section 14 or 15. Finally, the gunwale may have a plurality of openings 47 for use as handholds or through which lines can pass or be tied.

The folding portable boat 10 may have a skin which encases the floatation material 61 of which the hull sections 12, 13, 14, and 15 are made. The skin may be made from fiberglass, aluminum, thermoplastic or from a woven structure/resin transfer molding other than fiberglass. Whether or not the flotation material of which the hull sections are made has a skin, the floatation material provides buoyancy so that Coast Guard certification rules are satisfied. Thus, the folding portable boat can replace any required life rafts.

The folding portable boat 10 may have a mast 48 removably attached to one of the end hull sections 12 or 13 as shown in FIG. 4. The mast may be mounted by any mechanical means, many of which are known in the art. For example, the mast 48 may be set in a commercially-available, screw-on mast mounting 49 which is an upstanding hollow stanchion with a flange for bolting onto the end hull section 13 as depicted in FIG. 4. For easy storage, preferably the mast telescopes to its full length from its shorter storage length. A sail 50 is attached to the mast for sailing.

Figure 12:
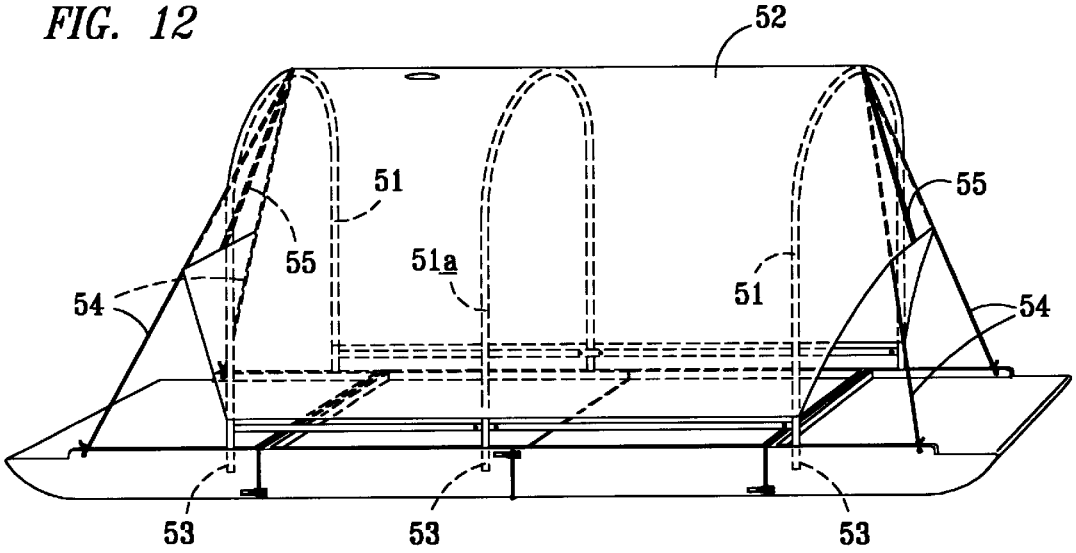
FIG. 12 is a perspective side view of the invention showing an optional canopy.

The folding portable boat 10 may also have a detachable canopy comprising a frame detachably mountable to the lateral side portions of the hull sections 12, 13, 14, and 15 and a canopy 52 detachably mountable to the frame. As shown in FIG. 12 (which for the sake of simplicity omits all parts other than the hull sections 12, 13, 14, and 15, the gunwale 46 and the canopy), the frame may consist of two inverted U-shaped poles 51 which slide into frame sockets 53 in either the gunwale 46 or in the lateral side portions 18 of the two end hull sections 12 and 13 and one U-shaped pole 51*a* which slides into frame sockets 53 in either the gunwale 46 or in the lateral side portions 18 of either of the middle hull sections 14 or 15. The poles 51 are preferably straight sectioned tent poles made of a flexible material that can be bent into a U-shape and that will return to a straight position when not held in the U-shaped position. In this case, the poles 51 are held in sockets 53 by the force exerted by the ends of the poles 51 as they tend to return to their straight position.

Canopy support lines 54 extend from poles 51 to be tied through openings 47 in the gunwale 46 on the lateral side portions 18 of the two end hull sections 12 and 13. Alternatively, not shown in the drawings but as will be obvious to those skilled in the art, canopy support lines 54 may be tied to eye hooks attached to the lateral side portions 18 of the two end hull sections 12 and 13. The canopy support lines 54 hold the canopy 52 open at the two end hull sections 12 and 13, support the poles 51 in upright positions and help keep the poles 51 in sockets 53. The canopy 52 may have zippers 55 on either or both ends both to control the size of the openings at the ends and to facilitate adding and removing the canopy onto the frame. The canopy 52 may have a rain-funneling edge 56 to direct the rain out of the boat 10. Preferably, the canopy 52 has sewn slots through which the poles 51 slide to hold the canopy in position on the frame.

As will readily be appreciate by those skilled in the art, the folding portable boat 10 may have additional middle hull sections (not shown in the drawings), such as a third middle hull section and a fourth middle hull section, hingedly interconnected between the two middle hull sections 14 and 15. The additional middle hull sections may be constructed similarly to the other middle hull sections 14 and 15 either with or without additional seat boards 23 and the erecting/collapsing means for automatically raising the seat boards 23 when the hull sections are unfolded and collapsing the seat boards 23 when the hull sections are folded.

The above embodiments are merely illustrative of the portable boat claimed herein. The invention also includes other embodiments, not specifically disclosed above or claimed below, which one skilled in the art would realize and envision as equivalents and derivations of the embodiments disclosed and claimed herein. Numerous variations may be made within the scope of this invention without departing from the principle of the invention and without sacrificing its chief advantages. Thus, the terms and expressions have been used as terms of description and not terms of limitation.

I claim:

1. A folding portable boat comprising:

a. two end hull sections and two middle hull sections each hull section being of a floatation material and each hull section having an outer portion, an inner portion and opposed lateral side portions;

b. the hull sections being hingedly interconnected adjacent to each other so they can be folded and unfolded in an accordion manner with the inner portion of each end hull section hingedly connected to the outer portion of one middle hull section and the middle hull sections hingedly connected to each other at their inner portions;

c. two seat boards each collapsibly associated with one of the middle hull sections; and d. an erecting/collapsing means for each seat board for causing the seat board to erect as the hull sections are unfolded and to collapse as the hull sections are folded.

2. The folding portable boat of claim 1 wherein the erecting/collapsing means for each seat board comprises:

a. a back having an upper edge, a lower edge and two side edges the lower edge hingedly connected to the outer portion of one of the middle hull sections;

b. two flanges each extending perpendicularly from one of the two side edges of the back and each flange having an opening in that part of the flange extending from the upper edge of the back;

c. two side boards, each being hingedly connected to one of the two lateral side portions of one of the middle hull sections;

d. the seat board hingedly connected to the upper edge of the back;

e. said erecting/collapsing means comprising two elastic means each being affixed to one lateral side portion of one of the end hull sections and each elastic means extending through one of the openings in one of the flanges and from there affixed to one of the two side boards so that as the hull sections are unfolded in an accordion manner the two elastic means operate to pull the back to an upright vertical position while simultaneously pulling the two side boards to upright vertical positions with the seat board falling by gravity to a horizontal position perpendicular to the side boards and the back;

d. a side board securing means for securing the side boards in upright vertical positions during use; and e. back securing means for securing the back in an upright vertical position during use.

3. The folding portable boat of claim 2 wherein the side board securing means comprises two slots in the seat board one for engaging each of the side boards to hold the side boards in upright vertical positions.

4. The folding portable boat of claim 2 wherein the back securing means comprises:

a. at least one first cord attached at one end to one lateral side portion of one of the end hull sections and attached at an opposing end to the upper edge of the back, the first cord being fully extended when the hull sections are unfolded; and b. at least one opposing cord attached at one end to one lateral side portion of one of the middle hull sections and attached at an opposing end to that part of the flange extending from the back at the point approximately opposite to the point on the back where the first cord is attached, with the opposing cord being fully extended when the hull sections are unfolded.

5. The folding portable boat of claim 1 further comprising a collapsible transom for mounting a motor or a rudder, the transom comprising:

a. a transom plate hingedly attached to the outer portion of one of the end hull sections, the transom plate having an approximately smooth inward facing surface;

b. a support plate having an approximately smooth inward facing surface and being hingedly attached to the end hull section inwardly from the transom plate for supporting the transom plate in an approximately vertical position by engaging the approximately smooth inward facing surface of the transom plate; and c. an elastic means attached to the transom plate and extending to the support plate for releasably engaging the support plate so that when the elastic means is released from the support plate both the support plate and the transom plate fold to permit the hull sections to be folded for storage, and so that when the elastic means is engaged it holds the support plate in a fixed position against the approximately smooth inward facing surface of the transom plate so that force transmitted to the transom plate in either direction through force exerted on a motor or a rudder causes the transom plate to deflect forward or backward and return to an approximately vertical position when the force is removed.

6. The folding portable boat of claim 1 further comprising a removable centerboard removably attached to one of the end hull sections so the centerboard may be attached after the hull sections are unfolded and removed prior to folding the hull sections.

7. The folding portable boat of claim 1 further comprising two removable centerboards each removably attached to one of the end hull sections so the centerboards can be attached after the hull sections are unfolded and removed prior to folding the hull sections.

8. The folding portable boat of claim 1 further comprising a storage compartment in one of the middle hull sections.

9. The folding portable boat of claim 1 further comprising two storage compartments each in one of the middle hull sections.

10. The folding portable boat of claim 1 wherein the two middle hull sections are hingedly interconnected at their inner portions by means of a detachable hinge so the folding portable boat can be separated into two separate units.

11. The folding portable boat of claim 1 further comprising a gunwale extending along the length of the lateral side portions and the outer portions of the two middle hull sections, along the inner portions of the two end hull sections and along approximately two-thirds of the length of the lateral side portions of both end hull sections; and wherein the gunwale defines compartment into which the seat boards and the erecting/collapsing means collapse when the hull sections are folded.

12. The folding portable boat of claim 11 wherein the gunwale has a plurality of openings for use as handholds or through which lines can pass or be tied.

13. The folding portable boat of claim 1 further comprising a skin which encases the floatation material of which the hull sections are made wherein the skin is made from a material selected from the group consisting of fiberglass, aluminum, and thermoplastic.

14. The folding portable boat of claim 1 further comprising a skin which encases the floatation material of which the hull sections are made, the skin being made from a woven structure/resin transfer molding.

15. The folding portable boat of claim 1 further comprising a holding means for holding the hull sections in a folded position when the boat is folded.

16. The folding portable boat of claim 1 further providing a detachable canopy comprising:

a. a frame detachably mountable to the lateral side portion of the hull sections;

b. a canopy detachably mountable to the frame; and c. a plurality of lines for tying the canopy to the lateral side portions of the hull sections and to the outer portions of the end hull sections.

17. The folding portable boat of claim 6 further comprising:

a. a mast removably attached to one end hull section; and b. a sail attached to the mast for sailing.

18. A folding portable boat comprising:

a. two end hull sections and two middle hull sections each hull section being of a floatation material and each hull section having an outer portion, an inner portion and opposed lateral side portions;

b. the hull sections being hingedly interconnected adjacent to each other so they can be folded and unfolded in an accordion manner with the inner portion of each end hull section hingedly connected to the outer portion of one middle hull section and the middle hull sections hingedly connected to each other at their inner portions;

c. a back having an upper edge, a lower edge and two side edges the lower end hingedly connected to the outer portion of one of the middle hull sections;

d. two flanges each extending perpendicularly from one of the two side edges of the back and each flange having an opening in that part of the flange extending from the upper edge of the back;

e. two side boards, each being hingedly connected to one of the two lateral side portions of one of the middle hull sections;

f. a seat board hingedly connected to the upper edge of the back;

g. two elastic means each being affixed to one lateral side portion of one of the end hull sections and each elastic means extending through one of the openings in one of the flanges and from there affixed to one of the two side boards so that as the hull sections are unfolded in an accordion manner the two elastic means operate to pull the back to an upright vertical position while simultaneously pulling the two side boards to upright vertical positions with the seat board falling by gravity to a horizontal position perpendicular to the side boards and the back;

d. a side board securing means for securing the side boards in upright vertical positions during use; and h. back securing means for securing the back in an upright vertical position during use.

* * * * *